US005728669A

United States Patent [19]

Tyerech

[11] Patent Number: 5,728,669

[45] Date of Patent: Mar. 17, 1998

[54] SHELF STABLE HYDROGEN PEROXIDE CONTAINING CARPET CLEANING AND TREATMENT COMPOSITIONS

[75] Inventor: Michael Richard Tyerech, Fort Lee, N.J.

[73] Assignee: Reckitt & Colman Inc., Montvale, N.J.

[21] Appl. No.: 843,121

[22] Filed: Apr. 25, 1997

[30] Foreign Application Priority Data

Jan. 16, 1997 [GB] United Kingdom ..... 9700791

[51] Int. Cl.[6] ..... C11D 1/14; C11D 3/24; C11D 3/395; D06L 3/02

[52] U.S. Cl. ..... 510/280; 510/278; 510/299; 510/303; 510/309; 510/310; 510/352; 8/137; 8/111; 427/393.4; 106/2

[58] Field of Search ..... 510/280, 278, 510/299, 303, 309, 310, 352; 8/137, 111; 106/2; 427/393.4

[56] References Cited

U.S. PATENT DOCUMENTS

| | | | |
|---|---|---|---|
| 3,901,727 | 8/1975 | Loudas | 134/4 |
| 3,916,053 | 10/1975 | Sherman et al. | 428/96 |
| 3,923,715 | 12/1975 | Dettre et al. | 260/29.6 R |
| 4,029,585 | 6/1977 | Dettre et al. | 252/8.6 |
| 4,043,923 | 8/1977 | Loudas | 252/8.75 |
| 4,145,183 | 3/1979 | Bostwick | 8/111 |
| 4,145,303 | 3/1979 | Loudas | 252/156 |
| 4,279,796 | 7/1981 | Tarkinson | 260/29.6 |
| 4,325,857 | 4/1982 | Champaneria et al. | 523/412 |
| 4,340,749 | 7/1982 | Patel | 560/182 |
| 4,388,372 | 6/1983 | Champaneria et al. | 428/395 |
| 4,565,717 | 1/1986 | Hosegood et al. | 427/339 |
| 4,595,518 | 6/1986 | Raynolds et al. | 252/8.6 |
| 4,937,123 | 6/1990 | Chang et al. | 428/96 |
| 5,252,232 | 10/1993 | Vinod | 252/8.6 |
| 5,252,243 | 10/1993 | Minns | 252/102 |
| 5,259,848 | 11/1993 | Terry et al. | 8/111 |
| 5,284,597 | 2/1994 | Rees | 252/103 |
| 5,338,475 | 8/1994 | Corey et al. | 252/102 |
| 5,348,556 | 9/1994 | Minns et al. | 8/137 |
| 5,370,919 | 12/1994 | Fieuws et al. | 428/96 |
| 5,439,610 | 8/1995 | Ryan et al. | 252/174.23 |
| 5,492,540 | 2/1996 | Leifheit et al. | 8/111 |
| 5,534,167 | 7/1996 | Billman | 510/280 |
| 5,601,910 | 2/1997 | Murphy et al. | 442/79 |
| 5,637,657 | 6/1997 | Anton | 525/445 |
| 5,672,651 | 9/1997 | Smith | 524/590 |

FOREIGN PATENT DOCUMENTS

| | | | |
|---|---|---|---|
| A-42875/89 | 5/1990 | Australia | C11D 3/39 |
| 0 629 694 A1 | 12/1994 | European Pat. Off. | C11D 3/39 |
| 2 200 365 | 8/1988 | United Kingdom | C11D 3/37 |
| WO 95/34630 | 12/1995 | WIPO | C11D 3/39 |
| WO 96/11249 | 4/1996 | WIPO . | |

*Primary Examiner*—Douglas J. McGinty
*Assistant Examiner*—John M. Petruncio
*Attorney, Agent, or Firm*—Fish & Richardson P.C.

[57] ABSTRACT

Shelf stable, hydrogen peroxide containing carpet cleaning and treatment compositions provide good cleaning efficacy particularly with oxidazable stains, and impart oil repellency properties to treated carpet fibers.

18 Claims, No Drawings

SHELF STABLE HYDROGEN PEROXIDE CONTAINING CARPET CLEANING AND TREATMENT COMPOSITIONS

The present invention relates to compositions for the treatment of a fibrous substrate, especially carpet fibers and carpets, which imparts oil repellency as well as a cleaning benefit. More particularly the instant invention provides a shelf stable, hydrogen peroxide containing cleaning and treatment composition particularly useful with fibrous substrates, especially carpet fibers and carpets, which composition provide a significant cleaning benefit and imparts oil repellency to the treated fibrous substrates.

Fibrous substrates, particularly carpets and carpeted surfaces and commonly encountered in both domestic, commercial and public environments. Carpets provide a pleasant surface covering, especially floor surfaces, and in some cases, wall surfaces which are durable, help deaden sound transmission, are in some part thermally insulating, and are readily applied. In order to retain their attractive appearance, such carpet surfaces require maintenance, particularly cleaning. Such cleaning may be of a general nature such as by vacuuming, wherein loose particulates are withdrawn from said carpet surface, as well as more intensive cleaning operations, including general shampooing and cleaning, as well as spot cleaning where a limited area or locus surrounding a stain is treated in order to remove it.

The consequence of such intensive cleaning operations is very frequently the reduction or removal of anti-staining characteristics which may have been imparted to the carpet fiber at the time of its production, such as by treatment by a wide variety of known compounds. The purpose of such compounds, and such carpet treatment compositions is to provide the carpet fibers with a degree of oil repellency. Further staining compositions include any variety number of other materials which may come into contact with the carpet and which are entrained amongst the carpet fibers and/or upon the carpet fiber surface. Unfortunately, such carpet fiber treatments and treatment compositions when applied frequently wear away with time due to the normal wear and tear associated with such an installed carpet surface, and/or may be deleteriously degraded and/or removed by one or more chemicals or other compositions which may be used in the intensive cleaning of a carpet surface.

Australian Patent No. AU-A-42875/89 describes an aqueous carpet cleaning compositions which includes a small mount of a perfluoropropionate and a perfluoroalkyl phosphate as well as mixtures thereof, a small mount of a nonionic, anionic or amphoteric surfactant or mixture thereof, a pH adjusting agent, and water, as well as minor mounts of other conventional additives.

U.S. Pat. No. 5,259,848 describes specific processes for the removal of stains which include the application of an ammonium salt with a peroxide, especially a combination of an ammonium bicarbonate and peroxide. The process contemplates the use of a two-part formulation where in a first formulation part containing a solution of the ammonium salt and a fluorinated alkyl sulfonic acid is mixed just prior to use with a second formulation part which includes a solution of hydrogen peroxide.

GB Patent No. 2,200,365-A describes a detergent composition which can be used in cleaning soiled carpet surfaces which includes between 0.01–50% by weight of a silicone or siloxane compound in conjunction with a 50% and greater proportion of one or more conventional surfactants.

U.S. Pat. No. 5,252,243 describes an processes for cleaning coffee stained carpet fibers which contemplate the use of an aqueous carpet cleaning composition which comprises hydrogen peroxide and a water soluble alcohol wherein such composition is at a pH of from 9 to 12.

U.S. Pat. No. 4,279,796 describes a carpet cleaning composition as well as a specific process for its application which carpet cleaning composition is an aqueous dispersion containing a non-fluorinated vinyl polymer, a perfluoroalkyl ester of carboxylic acid, and hydrogen peroxide.

U.S. Pat. No. 5,552,580 describes carpet cleaning compositions.

U.S. Pat. No. 5,348,556 describes an aqueous carpet cleaning and sanitizing composition which contains peroxide, an ammoniated substance and a volatile wetting agent. The composition is provided as a two-part formulation which is intended to be mixed immediately prior to its application onto a soiled carpet.

Published European Patent Application 629694 describes certain acidic peroxide containing aqueous compositions which include an inorganic or an organic peroxide as a source of active oxygen. The aqueous compositions as cited to be useful in the removal of soils and stains from carpets.

U.S. Reissue Pat. No. 30,337 as well as U.S. Pat. No. 4,043,923 describes cleaning and treatment compositions which may be used for the treatment of amongst other substrates, carpet surfaces. Compositions described therein include as an essential constituent certain novel detergent compatible organic fluorochemical compounds which are described as being useful in otherwise conventional cleaning compositions containing anionic or nonionic surface active agents which are used as detersive constituents. These particular fluorochemical compounds are recited as imparting both oil repellency and water repellency to treated carpet samples.

U.S. Pat. No. 4,145,303 and U.S. Pat. No. 3,901,727 both to Loudas describes a water dilutable alkaline cleaning composition which includes amongst its constituents at least one zinc or zirconium coordination complex which is water dispersible and capable of combining with substantially all of the acid radicals which are otherwise present in the composition, as well as up to about 1.5 parts of at least one fluorochemical compound having acid functionality which fluorochemical compound is capable of imparting water and oil repellency to the substrate.

U.S. Pat. No. 5,370,919 to Fieuws describes a composition effective for imparting water and oil repellency as well as stain resistance and dry soil resistance to textiles, carpets, as well as other substrates which contains a fluoroaliphatic radical containing a polyoxyalkylene compound, an anti-soiling agent, and up to 60% by weight of an environmentally acceptable water miscible organic solvent as well as water.

U.S. Pat. No. 5,439,610 to Ryan et al, discloses aqueous cleaning compositions which include sodium lauryl sulfate, ethylene glycol monohexyl ether, a flurosurfactant, a carboxylated polymer salt and tetrasodium ethylenediamine tetraacetate in specific weight ranges. The said cleaning compositions are recited to be useful cleaners for carpet surfaces, and to provide an oil repellent characteristic thereto.

U.S. Pat. No. 5,338,475 to Corey et al. discloses acidic aqueous carpet cleaning compositions which include hydrogen peroxide, a surfactant, and an anti-resoiling composition based on a mixture of an α-ω-fluoropoly-(difluoromethylene) lithium and a diethanolamine salt of a perfluoroalkyl phosphate which was commercially available as ZONYL 6885, but which is no longer commercially available.

U.S. Pat. No. 5,284,597 to Rees notes certain aqueous soft surface cleaning compositions which include a tertiary alkyl hydroperoxide and which are cited as being useful in the removal of certain stains from carpeting.

Published International Patent Application WO95/34630 also describes certain hydrogen peroxide containing soft surface cleaning compositions which are cited to be useful in cleaning of oxidizable and non-oxidizable stains.

While the prior art has proposed many such cleaning compositions, they have not uniformly met with success. Accordingly there remains a real and continuing need in the art for the provision of improved cleaning compositions, particularly cleaning compositions useful in the cleaning of carpet fibers and carpet surfaces. There is a further need in the art for improved carpet cleaning compositions which impart oil repellency to carpet fibers and carpet surfaces treated with such a composition. Specifically, there is a real need in the art for compositions which are particularly useful in the localized or spot cleaning of stains on carpet surfaces, especially difficult to clean stains such as cola soft drinks, grape juice, etc., and at the same time provide a useful degree of protection against oily stains.

Accordingly certain deficiencies of such prior art compositions are addressed and overcome by the present invention which provide aqueous cleaning and surface treatment compositions for imparting oil repellency to treated surfaces especially carpets and carpet fibers which comprise the following constituents:

urethane perfluoroalkyl ester constituent;

an oxidizing agent constituent, preferably a peroxyhydrate or other agent which releases hydrogen peroxide in aqueous solution;

anionic surface active agent, preferably one or more selected from alkyl sulfates, and alkyl sulfonates as well as salts thereof;

one or more organic solvents;

water

The compositions according to the invention may optionally, but in some cases desirably include one or more additives including but not limited to:

preservatives, coloring agents such as dyes and pigments, fragrances, anti-foaming agents, pH adjusting agents, buffer compositions, anti-soiling agents and resoiling inhibitors, chelating agents, optical brighteners, further solvents or surfactants, as well as one or more further fluorosurfactant compositions such as sulfonated aliphatic flurosurfactant compounds.

The compositions of the invention desirably exhibit a pH of about 4 or more.

The compositions of the invention desirably exhibit good shelf stability and are particularly useful with fibrous substrates, especially carpet fibers and carpets, and provides a significant cleaning benefit and imparts oil repellency to the treated fibrous substrates. The compositions according to the invention desirably maintain at least about 70% of their initial hydrogen peroxide content subsequent to accelerated aging testing for at least about 21 days as described hereafter. The compositions according to the invention desirably also retain at least about 70% of their initial hydrogen peroxide content subsequent to room temperature (20° C.) aging for at least about 40 weeks, and more desirably at least about 1 year. Such a combination of features is not believed to have been known to the art.

The compositions according to the invention comprise one or more urethane perfluoroalkyl esters. Desirably this constituent is a polyfunctional perfluoroalkyl ester urethane which is emulsified utilizing sodium dodecyl benzene sulfonate and is available in an aqueous preparation containing approximately 38% wt.–42% wt. of the ester as TBCU-A from DuPont De Nemours Inc. (Wilmington Del.). Desirably the urethane perfluoroalkyl ester constituent is present in the inventive compositions in an amount of from about 0.01% wt. to about 1% wt. based on the total weight of the constituent, and more desirably is present in an amount of from about 0.3% wt. to about 0.5% wt. based on the total weight of this constituent; such weights are based on the total weight of the "as is" provided constituent, and not on the amount of the perfluoroalkyl esters which it contains.

The compositions of the invention further include an oxidizing agent, which is preferably a peroxyhydrate or other agent which releases hydrogen peroxide in aqueous solution. Such materials are per se, known to the art. As used in this specification, a peroxyhydrate is to be understood as to encompass hydrogen peroxide as well as any material or compound which in an aqueous composition yields hydrogen peroxide. Examples of such materials and compounds include without limitation: alkali metal peroxides including sodium peroxide and potassium peroxide, alkali perborate monohydrates, alkali metal perborate tetrahydrates, alkali metal persulfate, alkali metal percarbonates, alkali metal peroxyhydrate, alkali metal peroxydihydrates, and alkali metal carbonates especially where such alkali metals are sodium or potassium. Further useful are various peroxydihydrate, and organic peroxyhydrates such as urea peroxide. Desirably the oxidizing agent is hydrogen peroxide.

Desirably the oxidizing agent, especially the preferred hydrogen peroxide is present in the inventive compositions in an amount of from about 0.5% wt. to about 3.0% wt., and more desirably is present in an amount of about 1% wt. based on the total weight of the composition of which it forms a part.

Minor amounts of stabilizers such as one or more organic phosphonates, stannates, pyrophosphates, as well as citric acid as well as citric acid salts may be included and when present considered as part of the oxidizing agent. The inclusion of one or more such stabilizers aids in reducing the decomposition of the hydrogen peroxide due to the presence of metal ions and or adverse pH levels in the inventive compositions. These usually form only a minor proportion (less than about 10% wt.) relative to the weight of the oxidizing agents.

A further constituent of the invention is an anionic surface active agent, which include compounds known to the art as useful as anionic surfactants. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Further exemplary anionic surface active agents which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

Particularly useful anionic surface active agents, also known as anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols (C8–C18 carbon atoms) such as those produced by reducing the glycerides of tallow or coconut oil; and the alkylbenzene sulfonates in which the alkyl group contains from about 9 to about 15 carbon atoms, in straight chain or branched chain. Especially valuable are linear straight chain alkylbenzene sulfonates in which the average number of carbon atoms in the alkyl group is from about 11 to 14.

Other anionic surfactants herein are the water soluble salts of: paraffin sulfonates containing from about 8 to about 24 (preferably about 12 to 18) carbon atoms; alkyl glyceryl ether sulfonates, especially those ethers of C8-18 alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Particularly preferred alkyl sulfate anionic surfactants useful in forming the compositions of the invention are alkyl sulfates of the formula

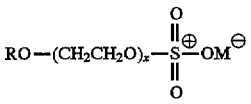

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the non-ethoxylated C12-15 primary and secondary alkyl sulfates.

Exemplary commercially available alkyl sulfates include one or more of those available under the tradename RHODAPON® from Rhône-Poulenc Co.(Cherry Hill, N.J.) as well as STEPANOL® from Stepan Chemical Co. (Northfield, Ill.) Exemplary alkyl sulfates which is preferred for use is a sodium lauryl sulfate surfactant presently commercially available as RHODAPON® LCP from Rhône-Poulenc Co., as well as a farther sodium lauryl sulfate surfactant composition which is presently commercially available as STEPANOL® WAC from Stepan Chemical Co.

Particularly preferred alkyl sulfonate anionic surfactants useful in forming the compositions of the present invention are alkyl sulfonates according to the formula

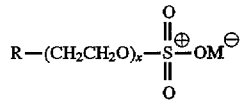

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the C12-15 primary and secondary alkyl sulfates.

Exemplary, commercially available alkane sulfonate surfactants include one or more of those available under the tradename HOSTAPUR® from Hoechst Celanese. An exemplary alkane sulfonate which is preferred for use is a secondary sodium alkane sulfonate surfactant presently commercially available as HOSTAPUR® SAS from Hoechst Celanese.

Other anionic surface active agents not particularly enumerated here may also find use in conjunction with the compounds of the present invention.

Desirably the anionic surfactant according to constituent is selected to be of a type which dries to a friable powder. Such a characteristic facilitates the subsequent removal of such anionic surfactants from a fibrous substrate, especially carpets and carpet fibers, such as by brushing or vacuuming.

The anionic surfactant may be included in the present inventive compositions in an amount of from 0.001–2% wt., but are desirably included in amounts of from 0.1% wt–1.5% wt., even more desirably are included in amounts of from 0.5% wt.–1.2% wt such recited weights representing the amount of the anionic surfactant compound based on the total weight of the composition of which it forms a part.

The organic solvent constituent of the inventive compositions include one or more alcohols, glycols, acetates, ether acetates and glycol ethers. Exemplary alcohols useful in the compositions of the invention include $C_3$–$C_8$ primary and secondary alcohols which may be straight chained or branched. Exemplary alcohols include pentanol and hexanol. Exemplary glycol ethers include those glycol ethers having the general structure Ra—O—Rb—OH, wherein Ra is an alkoxy of 1 to 20 carbon atoms, or aryloxy of at least 6 carbon atoms, and Rb is an ether condensate of propylene glycol and/or ethylene glycol having from one to ten glycol monomer units. Preferred are glycol ethers having one to five glycol monomer units.

By way of further non-limiting example specific organic constituents include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly useful is ethylene glycol hexyl ether, diethylene glycol hexyl ether.

The inventor has found as particularly useful are mixtures of two or more individual organic solvent constituents imparts the benefit of both good cleaning and soil penetration and at the same time effective solubilization of the fluorochemical surfactant composition in the aqueous compositions according to the invention. This has been observed particularly wherein one or more of the solvents which form the organic solvent constituent is relatively hydrophobic, and/or includes a C3–C8, but preferably a C5–C7 carbon chain which has been observed to adequately penetrate oily soils. One such preferred mixture of organic solvents includes an organic solvent system which includes both at least one glycol ether with at least one C3–C8 primary or secondary alcohol, for example ethylene glycol hexyl ether with isopropanol; diethylene glycol methyl ether with isopropanol; as well as ethylene glycol hexyl ether with 1-pentanol.

The organic solvent system according of the invention is present in amounts of from about 0.001% wt. to about 10% wt. More desirably the organic solvent constituent is present in an amount of from about 0.1% wt. to about 5% wt., and most desirably is present in an amount of from 0.5% wt. to 3% wt., as based on the total weight of the inventive composition of which it forms a part.

As is noted above, the compositions according to the invention are aqueous in nature. Water is added to order to provide 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention.

The compositions of the invention are acidic in nature, and the pH of the compositions of the invention are advantageously maintained below 7, more desirably within the range of about 4.0 to about 6.0, and most desirably is maintained to be about 5.5. Such may be achieved and maintained by the use of appropriate pH adjusting agents such as are known to the art, examples of which are described in more particular detail below. The present inventors have noted that the maintenance of the pH within these ranges and in particular within the preferred ranges is particularly important in order to assure the phase stability of the aqueous compositions.

The compositions according to the invention optionally but desirably include an amount of a pH adjusting agent or pH buffer composition. Such compositions include many which are known to the art and which are conventionally used. By way of non-limiting example pH adjusting agents include phosphor containing compounds, monovalent and polyvalent salts such as of silicates, carbonates, and borates, certain acids and bases, tartarates and certain acetates. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Desirably the compositions according to the invention include an effective amounts of an organic acid and/or an inorganic salt form thereof which may be used to adjust and maintain the pH or the compositions of the invention to the desired pH range. Particularly useful is citric acid and sodium citrate which are widely available and which are effective in providing these pH adjustment and buffering effects. Such a pH adjusting agent or pH buffer compositions are generally required in only minor amounts, with amounts of about 1% wt. and less based on the total weight of the composition having found to be effective.

The compositions of the invention may also include a fragrance compositions or other composition for modifying the scent characteristics of the inventive compositions. Such may be any of a number of known materials, and generally too such are also included in only minor amounts.

An optional additive which in certain formulations is desirably included is a sulfonated aliphatic fluorosurfactant compound. Such a compound is particularly useful in acting as a wetting agent, and in improving repellency characteristics especially oil repellency characteristics viz., the oleophobic characteristics of substrates treated with the compositions being taught herein. A particularly useful fluorosurfactant composition is a perfluoropropionate is ZONYL® TBS (E. I. DuPont Corp., Wilmington Del.) It is believed that ZONYL® TBS is manufactured in a process which does not involve the use of fluorocarbons, and while not wishing to be bound by the following, it is believed by the inventor that other perfluoropropionate fluorosurfactants which are also produced in a process which does not utilize fluorocarbons are also very advantageously used in the compositions according to the invention.

Such constituents as described above as essential and/or optional constituents include known art compositions, including those described in *McCutcheon's Emulsifiers and Detergents* (Vol. 1), *McCutcheon's Functional Materials* (Vol. 2), North American Edition, 1991; *Kirk-Othmer, Encyclopedia of Chemical Technology*, 3rd Ed., Vol. 22, pp. 346–387, the contents of which are herein incorporated by reference.

It is to be understood that although the aqueous cleaning compositions taught herein have been generally discussed in conjunction with the cleaning of carpets and carpet fibers, it is nonetheless to be understood that they may be utilized in the cleaning of a wide variety of fibers and fibrous substrates including but not limited to those which comprise fibers which are made of naturally occurring or synthetically produced materials, as well as blends or mixtures of such materials. Substrates which can be treated in accordance with this invention are textile fibers or filaments, either prior to their use, or as used in fabricated fibrous articles such as fabrics and textiles, rugs, carpets, mats, screens, and the like. Articles produced from such textiles, such as garments and other articles of apparel such as scarves, gloves and the like may also be treated. Further, sporting goods such as hiking and camping equipment made from or with a fabric or textile may also be treated with the cleaning compositions being taught herein in order to clean and/or impart a degree of oil repellency thereto. The textiles and fabrics include those made with or of one or more naturally occurring fibers, such as cotton and wool, regenerated natural fibers including regenerated cellulose, and those made with or of synthetically produced fibers, such as polyamides, polyolefins, polyvinylidene chlorides, acetate, nylons, polyacrylics, rayon, and polyester fibers. Blends of two or more such fibrous materials are also expressly contemplated. Such textiles and fabrics may be woven, non-woven or knitted materials.

The compositions of the invention can be prepared in a conventional manner such as by simply mixing the constituents in order to form the ultimate aqueous cleaning composition. The order of addition is not critical. Desirably, and from all practicable purposes, it is advantageous that the constituents other than water be added to a proportion of the total amount of water then well mixed, and most desirably that the surfactants be first added to the volume of water, followed by any remaining ingredients especially the optional constituents. Very desirably, the peroxide constituent is added last after the pH has been adjusted or has been determined to be acidic, as this is observed to benefit the stability of the peroxide. Subsequently any remaining balance of water, if any should be required, is then added. Optionally, the pH adjusting agents and/or pH buffering compositions be added in a sufficient amount in order to bring the formed composition within the pH range desired following the final addition of any remaining balance of water, but they may also be added at any other step including in an addition step preceding the addition of the fluorochemical.

The compositions of this invention may be packaged in any suitable container. They may be pressurized and made available in this form by means of the addition of a suitable propellant to the composition. Any propellant which can self-pressurize the composition and serve as the means for dispensing it from its container is suitable, including liquified gaseous propellants or inert compressed gases. The preferred propellants are liquified, normally gaseous propellants such as the known hydrocarbon and halogenated hydrocarbon propellants. The preferred normally gaseous hydrocarbon propellants include the aliphatic saturated hydrocarbons such as propane, butane, isobutane, and isopentane; the preferred halogenated hydrocarbons include chlorodifluoromethane, difluoroethane dichlorodifluoromethane and thel ike. Mixtures of two or more propellants can be used. The propellant is desirably utilized in an amount sufficient to expel the entire contents of the containers. In general, the propellant will be from about 5% to about 25%, preferably about 5% to about 15% by weight of the total composition. Pressurized forms of the compositions will generally be expelled from the container in the form of a foam.

Normally however, due to the acidic nature of the compositions and the likelihood of corrosion of pressurized aerosol containers, the manufacture of a product in a pressurized aerosol form is desirably avoided unless it is determined that such corrosion is unlikely as may be with the use of non-steel and/or lined aerosol containers.

The compositions according to the invention may also be packaged in a conventional container which includes a fluid reservoir or bottle portion which is adapted for containing a quantity of the composition, and further includes a manually operable pump. Manual actuation of the pump acts to withdraw the composition from within the said fluid reservoir and deliver it through a nozzle to an area to be treated. Such are well known to the art. Most desirably, the compositions are packaged and provided in a container especially a pressurized vessel or a manually operable pump which induces foaming of the composition as it is dispensed from the container.

The compositions according to the invention are used in a conventional manner in the cleaning of carpet surfaces. Generally, carpets are effectively cleaned by spraying about 20–80 grams per square foot of the carpeted surface with the aqueous cleaning composition and subsequently allowing said composition to penetrate amongst the carpet surface and the fibers. Desirably, this is further facilitated by the use of a manual agitation action, such as by rubbing an area of the carpet to be treated with a device such as a brush, sponge, mop, cloth, non-woven cloth, and the like until the aqueous cleaning composition is well intermixed amongst the carpet fibers. Where a carpet has an open pile, less manual agitation is usually required as opposed to carpets having closed loop piles wherein longer agitation and/or more vigorous agitation is generally required. This agitation may be repeated optionally by periodically rinsing the device in water and then reagitating and/or optionally reapplying an amount of the aqueous cleaning composition of the invention. This may continue until by visual inspection the soil is removed from the carpet surface to the cleaning device. Subsequently, the treated area is permitted to dry, which usually requires from as little as 10–20 minutes to as much as 24 hours or more in poorly heated and high humid locations. Generally, however, the drying period under typical conditions is between about 15 minutes to about 60 minutes. Optionally, but desirably, any remaining cleaning composition may be removed from the carpet such as by vacuuming in a conventional manner. In a further optional technique, the carpet may be brushed so to remove any residue of the aqueous cleaning composition from amongst the carpet fibers, and then vacuumed or brushed out from the carpeted area.

The hydrogen peroxide containing aqueous cleaning compositions according to the present invention provide good cleaning efficacy, and simultaneously provide and/or restore to the treated carpet surface a degree oil repellency, which is important in limiting the resoiling of the treated carpet surface, as well as for limiting the penetration of oily stains into the fiber substrate. Further the compositions exhibit acceptable shelf stability nothwithstanding the presence of a significant amount of hydrogen peroxide which is known to the art to be difficult to include in formulations due to the known tendency to oxidize other constituents in formulations and thus detract from their overall stability. As had been noted previously, many known prior art compositions provide no restoration of oil repellency to treated carpet surfaces, but are generally considered merely as cleaners, yet others may have imparting degree of oil repellency to a carpet surface, but not necessarily have provided any efficacious cleaning benefit. Thus, the compositions of the present invention provide these three simultaneous characteristics which are critical in maintaining the attractive appearance of carpeted surfaces, as well as concomitantly extending their useful service life.

The following examples illustrate the superior properties of the formulations of the invention and particular preferred embodiments of the inventive compositions. The terms "parts by weight" or "percentage weight" as well as "%% wt." are used interchangeably in the specification and in the following Examples wherein the weight percentages of each of the individual constituents are indicated in weight percent based on the total weight of the composition, unless indicated otherwise.

EXAMPLES

Illustrative exemplary formulations within the scope of the present inventive compositions are provided on Table 1 below, which are designated as "Example" or "Ex." formulations. Also included are certain formulations which are provided for the purpose of comparison, and such are designated as "Comparative" or "Comp." formulations; these do not include the "TBCUA" as a constituent.

TABLE 1

| | Formulations | | | | | | | | | | |
|---|---|---|---|---|---|---|---|---|---|---|---|
| | Comp. 1 | Comp. 2 | Comp. 3 | Comp. 4 | Ex. 1 | Ex. 2 | Ex. 3 | Ex. 4 | Ex. 5 | Ex. 6 | Ex. 7 |
| sodium lauryl sulfate (30%) | 2.60 | 2.60 | 2.60 | 3.00 | 2.60 | 2.60 | 2.60 | 2.60 | 2.60 | 2.60 | 2.60 |
| sodium alkane sulfonate (30%) | 0.40 | 0.40 | 0.40 | — | 0.40 | 0.40 | 0.40 | 0.40 | 0.40 | 0.40 | 0.40 |
| ethylene glycol hexyl ether | 1.00 | 1.00 | 1.00 | 1.25 | 1.00 | 1.00 | 1.00 | 1.00 | 1.00 | 1.25 | 1.25 |
| isopropanol | 2.00 | 2.00 | 2.00 | 2.00 | 2.00 | 2.00 | 2.00 | 2.00 | 2.00 | — | — |
| Zonyl TBS | — | — | — | 0.30 | 0.25 | 0.25 | 0.25 | 0.25 | 0.15 | — | — |
| TBCUA | — | — | — | — | 0.35 | 0.35 | 0.50 | 0.35 | 0.35 | 0.50 | 2.00 |
| Zonyl 7950 | 0.40 | 0.40 | — | — | — | — | — | — | — | — | — |
| Zonyl 6885 | — | — | 0.40 | — | — | — | — | — | — | — | — |
| sodium citrate | 0.10 | 0.10 | 0.10 | 0.10 | 0.10 | 0.10 | 0.10 | 0.10 | 0.10 | 0.10 | 0.10 |
| sodium carbonate | — | — | — | — | 0.02 | — | — | — | — | — | — |
| sodium bicarbonate | — | — | — | — | 0.01 | — | — | — | — | — | — |
| citric acid | 0.01 | 0.05 | 0.04 | 0.04 | — | 0.01 | — | — | — | 0.10 | 0.10 |
| hydrogen peroxide (50%) | 3.00 | 3.00 | 3.00 | 3.00 | 3.00 | 3.00 | 3.00 | 3.00 | 3.00 | 3.00 | 3.00 |
| fragrance | — | — | — | 0.20 | — | — | — | — | — | — | — |
| sodium hydroxide (5%) | — | — | — | 0.75 | — | — | 0.27 | 0.27 | 0.15 | — | — |
| DI water | q.s. | q.s. | q.s. | q.s. | q.s. | q.s. | q.s. | q.s. | q.s. | q.s. | q.s. |
| initial pH formulation | 6.45 | 4.37 | 5.41 | 6.82 | 6.78 | 5.11 | 6.80 | 6.78 | 6.68 | 5.73 | 5.80 |

It is to be understood that the amounts of the constituents are listed above are "as is" weights as supplied by the respective supplier. The identity of the individual constituents described in Table 1 above, as well as presently available commercial sources are described in more detail in Table 2, below.

TABLE 2

| CONSTITUENT LISTING | |
|---|---|
| sodium lauryl sulfate (30%) | STEPANOL WAC, 30% wt. actives (Stepan Chem. Co.) |
| sodium alkane sulfonate (30%) | HOSTAPUR SAS, 30% wt. actives (Hoechst-Celanese Co.) |
| ethylene glycol hexyl ether | Hexyl CELLOSOLVE (Union Carbide Co.) |
| isopropanol | isopropanol |
| ZONYL TBS (30%) | ZONYL TBS, 30% wt. actives (DuPont Co.) |
| TBCUA | TBCUA Carpet Protector, 38–42% wt. actives (DuPont Co.) |
| ZONYL 7950 | ZONYL 7950 perfluoroalkyl phosphate salt, 30% wt. actives (Dupont Co.) |
| ZONYL 6885 | ZONYL 6885 perfluoroalkyl phosphate salt, 30% wt. actives (DuPont Co.) |
| sodium citrate | sodium citrate (ADM Co.) |
| sodium carbonate | sodium carbonate (FMC Co.) |
| sodium bicarbonate | sodium bicarbonate (FMC Co.) |
| citric acid | citric acid (ADM Co.) |
| hydrogen peroxide (50%) | SUPER D (FMC Co.) |
| DI water | deionized water |

Certain of the formulations described on Table 1 were subjected to various tests including "normal" and "accelerated" aging tests during which initial evaluation of the levels of hydrogen peroxide as well as pH, and hydrogen peroxide levels and pH subsequent to testing was performed. In accordance with the accelerated aging test, a sample of a particular formulation is placed in a glass vessel and subjected to temperature of 120° F. for a period of days, usually 7 or 8 days, or for an extended period of 21 days. Such a test is intended to provide a useful approximation of the shelf stability of formulation. In accordance with the normal aging test, a sample of a particular formulation is placed in a vessel and maintained at room temperature (approx. 68° F.; 20° C.) for a period of a number of weeks. The results are reported on Table 3, below.

TABLE 3

| formulation | initial values | | | |
|---|---|---|---|---|
| | pH | | $H_2O_2$ conc. | |
| Comp. 1 | 6.45 | | 1.4738% wt. | |
| Comp. 2 | 4.37 | | 1.4680% wt. | |
| Comp. 3 | 5.41 | | 1.4606% wt. | |
| Ex. 1 | 6.78 | | 1.4724% wt. | |
| Ex. 2 | 5.11 | | 1.4705% wt. | |
| | accelerated aging testing | | | |
| | pH | days at 120° F. | $H_2O_2$ conc. | % $H_2O_2$ remaining |
| Comp. 1 | 6.41 | 8 days | 0.0035 | 0.24% wt. |
| Comp. 2 | 4.46 | 8 days | 0.0415 | 2.80% wt. |
| Comp. 3 | 5.57 | 7 days | 1.3570 | 92.9% wt. |
| Ex. 1 | 6.87 | 7 days | 1.3810 | 93.8% wt. |
| Ex. 2 | 5.43 | 8 days | 1.4359 | 97.6% wt. |
| | accelerated aging testing | | | |
| | pH | days at 120° F. | $H_2O_2$ conc. | % $H_2O_2$ remaining |
| Comp. 1 | — | — | — | — |
| Comp. 2 | — | — | — | — |
| Comp. 3 | 5.72 | 21 days | 1.2774 | 87.5% wt. |
| Ex. 1 | 5.94 | 21 days | 1.1470 | 76.4% wt. |
| Ex. 2 | 5.76 | 21 days | 1.3557 | 92.2% wt. |
| | room temperature $H_2O_2$ stability testing | | | |
| | | age of sample | $H_2O_2$ conc. | % $H_2O_2$ remaining |
| Comp. 1 | | — | | |
| Comp. 2 | | 6 weeks | 0.0543 | 3.62% wt. |
| Comp. 3 | | 34 weeks | 1.2866 | 88.1% wt. |
| Ex. 1 | | 40 weeks | 1.0964 | 74.5% wt. |
| Ex. 2 | | 39.5 weeks | 1.3121 | 89.2% wt. |
| Ex. 1 | | 52 weeks | 1.092 | 74.2% wt. |
| Ex. 2 | | 52 weeks | 1.262 | 84.6% wt. |

"—" indicates that the sample was not tested

These formulations are expected to provide a good cleaning benefit and to provide excellent stain removal of carpeted surfaces due to the presence of effective amounts of hydrogen peroxide, which is also present in sufficient amounts to act as an effective oxidizing agent. The formulations are also at an appropriate pH for oxidizing (bleaching) difficult to remove stains, such as grape juice, red wine, and the like.

Oil Repellency

Oil repellency characteristics of sample carpet swatches were evaluated generally in accordance with the following protocol. For this test, carpet swatch approximately 5 inches by 5 inches made of a light beige colored level loop nylon carpeting formed the standard testing substrate. Such carpet swatches are similar to those presently commercially available as DuPont® Stainmaster® carpets from a variety of commercial source, but differed from those commercially available as well as those described previously as they were produced without any fluorochemical fiber or surface treatments.

In the performance of the oil repellency testing, standardized oil compositions were utilized which are identified as follows the following: Oil #1 was a composition consisting solely of mineral oil; Oil #2 was a composition comprising 65 parts by weight mineral oil and 35 parts by weight hexadecane; Oil #3 consisted essentially of hexadecane; Oil #4 consisted essentially of tetradecane; and the last standardized Oil #5 consisted essentially of dodecane.

Clean, light beige colored sample carpet swatches of the same size and type as those used in the cleaning evaluations denoted above were treated with one of the formulations recited on Table 1. In the performance of the test a 15–20 gram amount of a single formulation was dispensed to the surface of the carpet swatch with the use of a manually pumpable trigger spray dispenser and thereafter rubbed into and amongst the carpet fibers for 30 seconds, in a manner to adequately cover the entire surface of the sample carpet swatch. The thus treated swatch was then allowed to set for 24 hours at room temperature (approximately 25° C., 50% relative humidity).

Subsequently, the standardized oils were used in rising numerical sequence in order to evaluate the oil repellent characteristics imparted to the treated carpet swatches. Beginning with Oil #1, a drop of said oil was placed upon the surface of the carpet fiber and it was observed carefully. If the oil droplet maintained a bead on the carpet surface for 30 seconds, this treated carpet swatch was judged to have a rating of at least "1". The protocol was repeated in a different part of the carpet utilizing the next numerically higher oil number, in this case, Oil #2. Again, if the oil droplet maintained a bead on the carpet surface for 30 seconds, this treated carpet swatch was judged to have a rating of at least "2". This protocol was repeated using in sequence standardized oils #3, #4 and #5 until a standardized oil failed to maintain its bead upon the surface of the carpet for the 30 second period noted above. If the bead of a particular standardized oil was observed to be partially but not totally absorbed by the carpet swatch, or to slump in its appearance during the 30 second interval, then a value of "0.5" was added to the prior number of the standardized oil which maintained a droplet bead on the carpet surface for 30 seconds, and this number was reported. Otherwise, the highest numbered standardized oil which did maintain its bead upon the surface during the 30 second interval was reported on Table 4 following.

TABLE 4

| REPELLENCY | |
|---|---|
| | testing results |
| Comp. 1 | 4 |
| Comp. 2 | 4 |
| Comp. 3 | 4 |
| Comp. 4 | 0 |
| Ex. 1 | 4 |
| Ex. 2 | 4 |
| Ex. 3 | 4 |
| Ex. 4 | 3 |
| Ex. 5 | 2 |
| Ex. 6 | 1 |
| Ex. 7 | 1 |

As may be readily seen from the results illustrated on Table 4, the formulations according to Examples 1–3 exhibited excellent oil repellency characteristics similar to the comparative examples. The formulations according to Examples 4–7 exhibited progressively poorer, yet effective, oil repellency characteristics to the treated carpet surfaces. Of note is that the formulation which did not include the TBCU-A material, but did include the ZONYL® TBS material exhibited no oil repellency.

Motor Oil Repellency

In order to provide a further indicator of the characteristics of the repellency imparted to a sample carpet in a setting more approximate to a consumer or end-user environment, a motor oil repellency test was performed. The motor oil used in the test was a used automotive grade motor oil. Such are known to be greenish-brown in color, viscous and notorious in both theft staining ability, as well as the difficulty associated in removing them from fibers, especially carpet surfaces. According to the test, a sample carpet swatch treated with a formulation according to Table 1 is evaluated by placing one (or more) drops of the motor oil on the surface of the treated swatch and the rate at which the motor oil is absorbed into the carpet is indicated.

The results of such test are indicated on Table 5, following.

TABLE 5

| MOTOR OIL REPELLENCY | |
|---|---|
| | observations |
| Comp. 4 | 0 minutes |
| Ex. 3 | good after 120 minutes |
| Ex. 4 | good after 30 minutes |
| Ex. 5 | good after 10 minutes |
| Ex. 6 | good after 5 minutes |
| Ex. 7 | good after 90 minutes |

For each of the treated carpet samples, the oil placed upon the surface of the treated carped was observed to remain beaded and unabsorbed by the carpet fibers in for the time periods noted above. These results indicate the excellent oil repellency characteristics which are imparted by the present inventive compositions. Again, as may be seen from the results reported for Comparative Example 4, the formulation which did not include the TBCU-A material, but did include the ZONYL® TBS material exhibited no oil repellency.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

I claim:

1. Aqueous cleaning and surface treatment compositions for imparting oil repellency to carpets and carpet fibers which comprise:

a urethane perfluoroalkyl ester constituent;

an oxidizing agent constituent;

anionic surface active agent;

one or more organic solvents;

water.

2. A process for the treatment of fibrous substrates which comprises the process step of:

contacting said fibrous substrate with an effective amount of the composition according to claim 1.

3. Aqueous cleaning and surface treatment compositions according to claim 1 wherein the oxidizing agent constituent is a peroxyhydrate which releases hydrogen peroxide in aqueous solution.

4. Aqueous cleaning and surface treatment compositions according to claim 1 wherein the oxidizing agent constituent is selected from: sodium peroxide, potassium peroxide, alkali perborate monohydrates, alkali metal perborate tetrahydrates, alkali metal persulfate, alkali metal percarbonates, alkali metal peroxyhydrate, alkali metal peroxydihydrates, alkali metal carbonates, peroxydihydrates, organic peroxyhydrates, urea peroxide and hydrogen peroxide.

5. Aqueous cleaning and surface treatment compositions according to claim 4 wherein the oxidizing agent constituent is hydrogen peroxide.

6. Aqueous cleaning and surface treatment compositions according to claim 1 wherein the anionic surface active agent is selected from alkyl sulfates, and alkyl sulfonates as well as salts thereof.

7. Aqueous cleaning and surface treatment compositions according to claim 6 wherein the anionic surface active agent is an alkyl sulfate of the formula

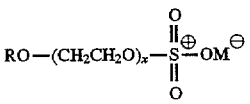

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4.

8. Aqueous cleaning and surface treatment compositions according to claim 6 wherein the anionic surface active agent is an alkyl sulfonates according to the formula

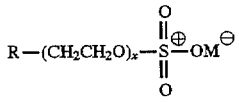

wherein R is an straight chain or branched alkyl chain having from about 8 to about 18 carbon atoms, saturated or unsaturated, and the longest linear portion of the alkyl chain is 15 carbon atoms or less on the average, M is a cation, selected from the group consisting of alkali metal, ammonium and substituted ammonium, and x is from 0 to about 4.

9. Aqueous cleaning and surface treatment compositions according to claim 1 wherein the organic solvent constituent is selected from alcohols, glycols, acetates, ether acetates and glycol ethers.

10. Aqueous cleaning and surface treatment compositions according to claim 9 wherein the organic solvent constituent includes a glycol ether according to the general structure

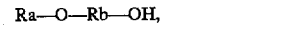

wherein Ra is an alkoxy of 1 to 20 carbon atoms, or aryloxy of at least 6 carbon atoms, and Rb is an ether condensate of propylene glycol and/or ethylene glycol having from one to ten glycol monomer units.

11. Aqueous cleaning and surface treatment compositions according to claim 10 wherein the organic solvent constituent is an organic solvent system which includes both at least one glycol ether with at least one C3–C8 primary or secondary alcohol.

12. Aqueous cleaning and surface treatment compositions according to claim 1 which further comprises one or more additives selected from: preservatives, coloring agents, fragrances, anti-foaming agents, pH adjusting agents, buffer compositions, anti-soiling agents and resoiling inhibitors, chelating agents, optical brighteners, solvents or surfactants, and fluorosurfactant compositions.

13. Aqueous cleaning and surface treatment compositions for imparting oil repellency to carpets and carpet fibers which comprise:

0.01%–1% wt. of a urethane perfluoroalkyl ester constituent;

0.5%–3.0% wt. of an oxidizing agent constituent;

0.001%–2% wt. of an anionic surface active agent;

0.001%–10% wt. one or more organic solvents.

14. Aqueous cleaning and surface treatment compositions according to claim 1 which maintain at least about 70% of their initial hydrogen peroxide content subsequent to accelerated aging testing for at least about 21 days.

15. Aqueous cleaning and surface treatment compositions according to claim 1 which maintain at least about 70% of their initial hydrogen peroxide content subsequent to room temperature aging for at least about 40 weeks.

16. Aqueous cleaning and surface treatment compositions according to claim 1 which maintain at least about 70% of their initial hydrogen peroxide content subsequent to room temperature aging for at least about 1 year.

17. Aqueous cleaning and surface treatment compositions according to claim 1 having a pH of less than about 7.

18. Aqueous cleaning and surface treatment compositions according to claim 1 having a pH from 4.0–6.0.

* * * * *

UNITED STATES PATENT AND TRADEMARK OFFICE

CERTIFICATE OF CORRECTION

PATENT NO. : 5,728,669

DATED : March 17, 1998

INVENTOR(S) : Michael Richard TYERECH

It is certified that error appears in the above-identified patent and that said Letters Patent is hereby corrected as shown below:

In column 15, lines 40-44, delete the chemical compound structure:

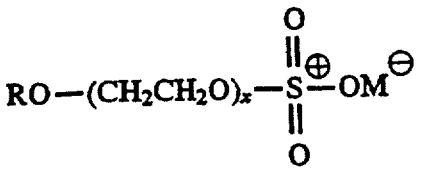

and insert the following chemical compound structure:

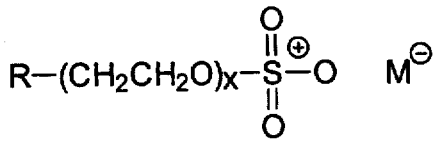

UNITED STATES PATENT AND TRADEMARK OFFICE

CERTIFICATE OF CORRECTION

PATENT NO. : 5,728,669

DATED : March 17, 1998

INVENTOR(S) : Michael Richard Tyerech

It is certified that error appears in the above-identified patent and that said Letters Patent is hereby corrected as shown below:

In column 15, lines 56-60, delete the chemical compound structure:

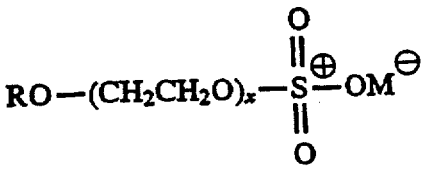

and insert the following chemical compound structure:

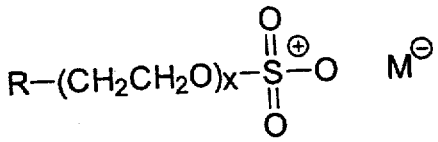

Signed and Sealed this

Twenty-sixth Day of May, 1998

*Attest:*

*Attesting Officer*

BRUCE LEHMAN

*Commissioner of Patents and Trademarks*